US005205402A

United States Patent [19]

Maeda

[11] Patent Number: 5,205,402

[45] Date of Patent: Apr. 27, 1993

[54] CIGARETTES CASE

[75] Inventor: Hikotaro Maeda, Nagoya, Japan

[73] Assignee: Nagoya Kenkotabako Yugen Kaisha, Nagoya, Japan

[21] Appl. No.: 813,748

[22] Filed: Dec. 30, 1991

[30] Foreign Application Priority Data

Dec. 28, 1990 [JP] Japan ..... 2-406880[U]

[51] Int. Cl.[5] ..... A24F 15/06; B65D 85/10

[52] U.S. Cl. ..... 206/250; 206/252; 206/255; 206/266; 206/804; 206/817; 220/264; 220/335

[58] Field of Search ..... 206/249, 250, 252, 254, 206/255, 265, 266, 267, 270, 804, 817; 220/263, 264, 335

[56] References Cited

U.S. PATENT DOCUMENTS

| | | | |
|---|---|---|---|
| 1,155,688 | 10/1915 | Shearman et al. | 206/255 X |
| 1,408,464 | 3/1922 | Moeller | 206/255 X |
| 1,475,567 | 11/1923 | Dall | 206/250 |
| 1,897,702 | 2/1933 | Lewnes | 206/255 |
| 1,978,497 | 10/1934 | Lind | 206/250 X |
| 1,994,218 | 3/1935 | Hiering | 206/266 X |
| 2,030,305 | 2/1936 | Koehler | 206/250 |
| 2,327,120 | 8/1943 | McCoon | 206/252 X |
| 2,519,020 | 8/1950 | Breitwieser | 206/252 |
| 3,446,338 | 5/1969 | Bozyk | 206/250 |
| 4,850,481 | 7/1989 | Chern | 206/249 |

*Primary Examiner*—Jimmy G. Foster
*Assistant Examiner*—Jacob K. Ackun, Jr.
*Attorney, Agent, or Firm*—Fred Philpitt

[57] ABSTRACT

A cigarettes case comprising (i) a case body with a top partially cut away to provide a top opening located adjacent to one side of the case body for taking out a cigarette from the case body, with a vertical slit provided in the one side, and with an opposed, open side for supplying cigarettes into the case body 1, (ii) a removable side wall member for closing the open side, and (iii) a slider located in the case body and having a lid portion, an upright portion, and a projecting bottom portion. The lid portion closes the top opening when the slider is on the bottom of the case body. The upright portion is in contact with the one side of the case body. The bottom portion projects toward the open side of the case body and has sufficient size to support at least one cigarette thereon. The upright portion is provided at its outer surface with a projection projecting outwardly through the slit. A handle is located outside the case body and is connected to the projection. In use, the user can apply, for example, his thumb to the handle to raise the slider. In one embodiment of the invention, the upright portion of the slider comprises an upper member and a lower member which are so connected by a pin that the upper member can be turned relative to the lower member, and a coil spring is provided on the pin to bias the upper member outwardly.

3 Claims, 4 Drawing Sheets

CIGARETTES CASE

FIELD OF THE INVENTION

This invention relates to a novel cigarettes case.

BACKGROUND OF THE INVENTION

Usually cigarettes are sold in a box of paper or cardboard with a small thickness. With a box of paper, it is necessary to partly or wholly break the top of the box to make an opening for taking out a cigarette from the box. Consequently, it is possible that a cigarette or cigarettes may accidentally come from the box. With a box of cardboard, it is necessary to open the lid of the box to take out a cigarette from the box and to close the lid after taking it out. Therefore, it is necessary to use both hands to take out a cigarette from the box.

SUMMARY OF THE INVENTION

The object of the invention is to provide a cigarettes case which is free from the above-mentioned drawbacks of the prior art.

DETAILED DESCRIPTION OF PREFERRED EMBODIMENTS

Figure 1:
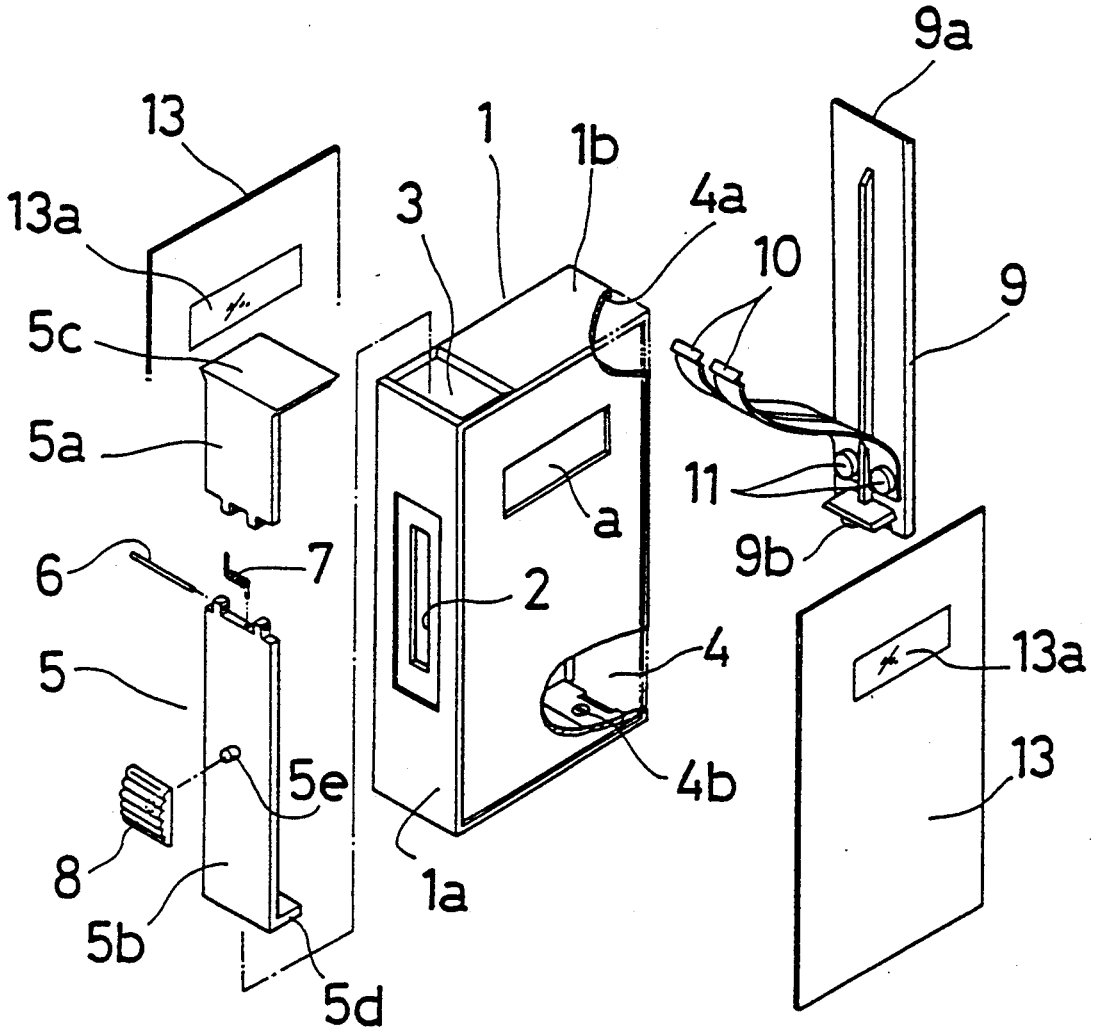
FIG. 1 is an exploded view of a cigarettes case of the invention.
Figure 2:
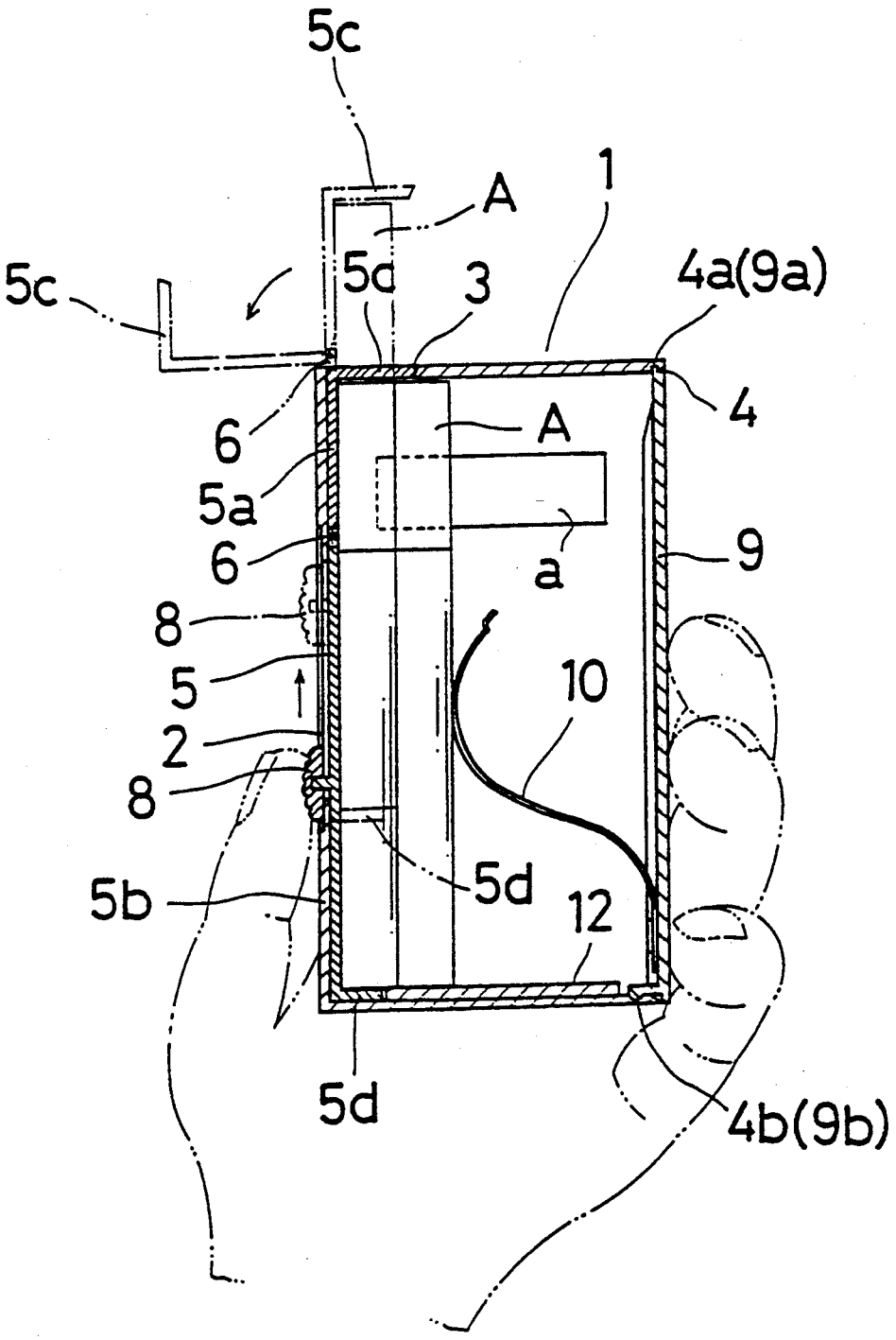
FIGS. 2 and 3 show how to use the cigarettes case.
Figure 3:
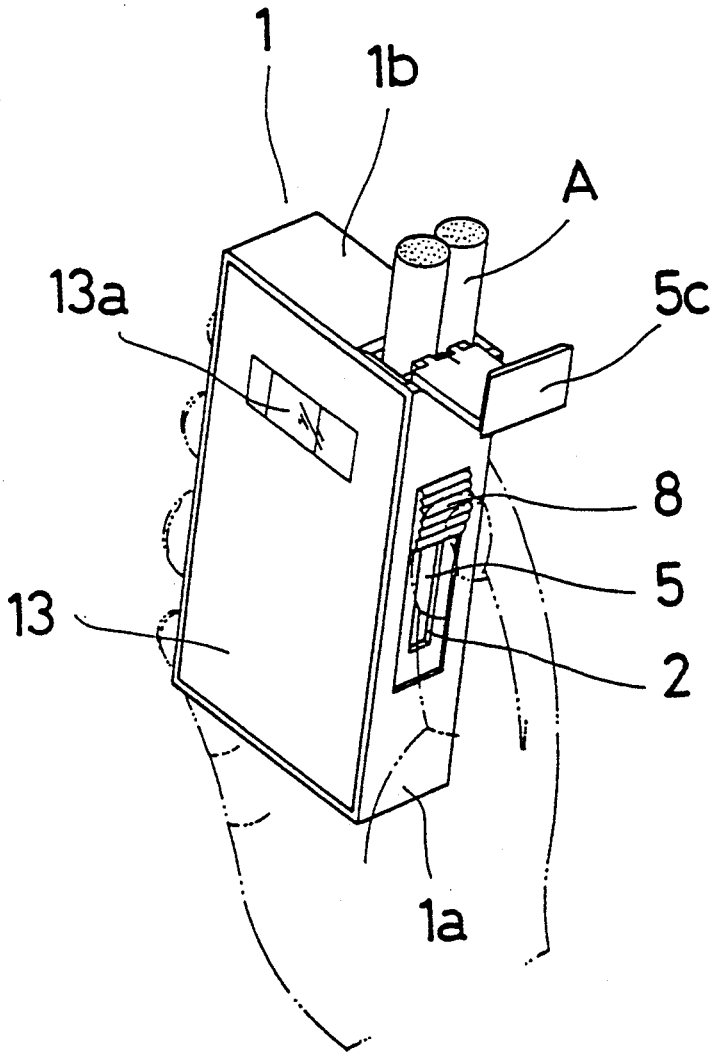
Figure 4:
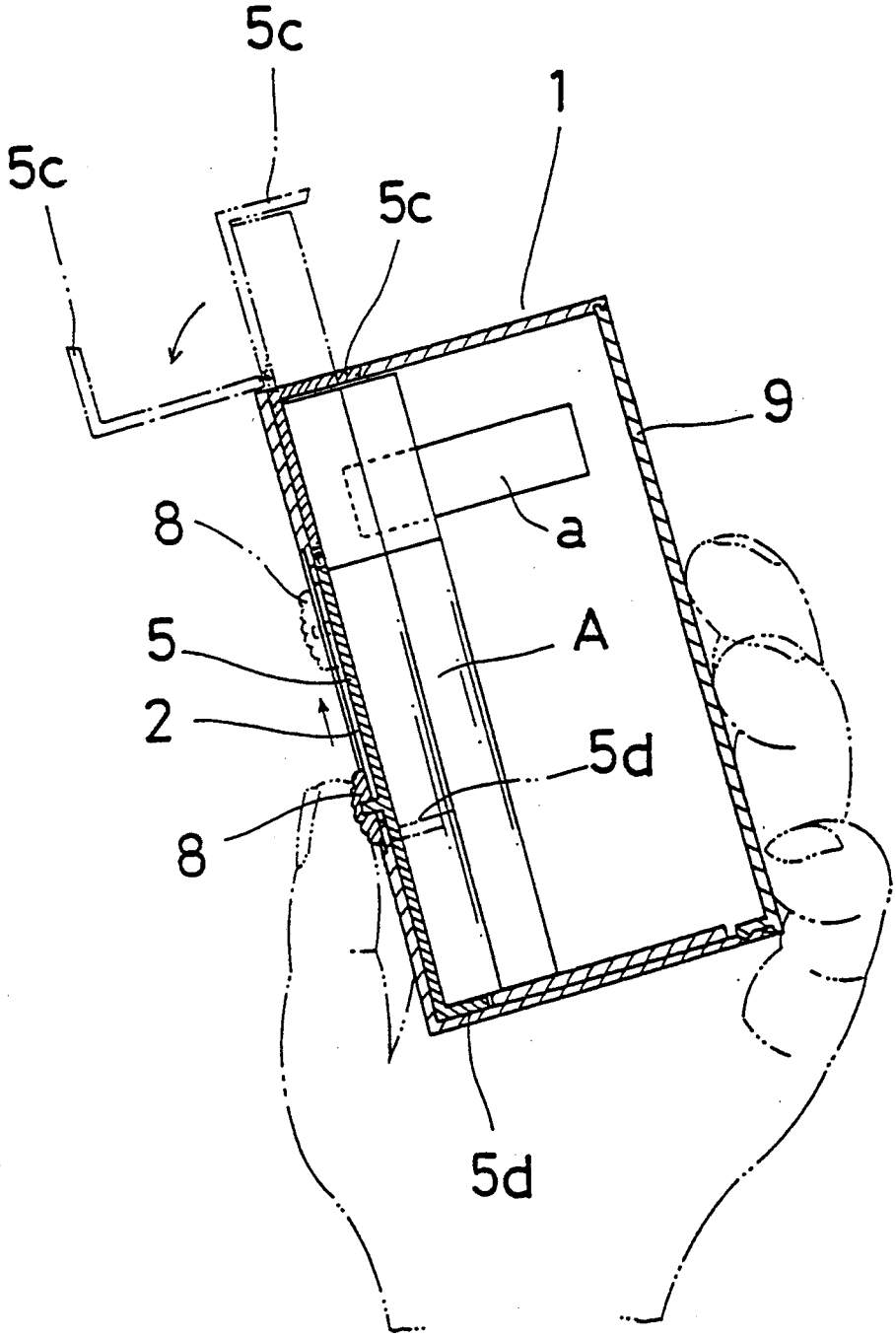
FIG. 4 shows a modification of the invention.

Referring to FIGS. 1 to 3, reference numeral 1 designates a rectangular case body. The case body 1 can accommodate two rows of five cigarettes and, hence, a total of ten cigarettes. One side 1*a* of the case body 1 is provided with a vertical slit 2. The top 1*b* of the case body 1 is provided with an opening 3 of sufficient size for two cigarettes to pass through the opening 3 at a time. The opposed side of the case body 1 is an open side 4, and is closed by a removable side wall member 9. The side wall member 9 has an upper projection 9*a* received in an upper recess 4*a* of the case body 1 and a lower projection received in a lower recess 4*b* of the case body 1. The front and rear of the case body 1 are provided with openings a, respectively, through which the user can have a look to see how many cigarettes are remaining in the case.

A slider 5 is disposed in the case body 1. The slider 5 comprises a lid portion 5*c*, an upright portion, and a projecting bottom portion 5*d*. The upright portion consists of an upper member 5*a* and a lower member 5*b* which are so connected by a pin 6 that the upper member 5*a* can be turned relative to the lower member 5*b*. The lid portion 5*c* is formed integrally with the upper member 5*a* and, hence, the former and the latter are one pivotable element. The lid portion 5*a* closes the opening 3 of the case body 1 when the bottom of the slider 5 is on the bottom of the case body 1. A coil spring 7 is provided on the pin 6, and biases the upper member 5*a* to turn it outwardly (as shown in FIG. 2). The upright portion has substantially the same area as the side 1*a* of the case body 1, and is in contact with the side 1*a*. The projecting bottom portion 5*d* is formed integrally with the lower member 5*b*, and projects toward the open side 4 of the case body 1 by a distance slightly smaller than the diameter of a cigarette A. The bottom portion 5*d* supports two cigarettes A which are in contact with the upright portion (5*a*, 5*b*).

The outer surface of the lower member 5*b* is provided with a small projection 5*e* projecting outwardly through the slit 2 of the case body 1. A handle 8 is connected to the projection 5*e*, and is located outside the case body 1.

As described above, the open side 4 of the case body 1 is closed by the removable side wall member 9. Two leaf springs 10 are fixed to the inner surface of the side wall member 9. Each leaf spring 10 is generally shaped like the alphabetical letter "S". When no cigarette is in the case body 1, the free upper end of each spring 10 is in contact with the upright portion of the slider 5. Thus, when cigarettes are in the case body, the free end of one spring 10 presses the cigarettes of one row against the slider 5 while the free end of the other spring 10 presses the cigarettes of the other row against the slider 5.

A plate 12 is located in the case body, and is fastened on the bottom of the case body 1 to provide a smooth surface for supporting the bottoms of the cigarettes.

Coverings 13 are attached to the front and rear of the case body, respectively. Each covering 13 covers almost the entire front or rear face of the case body 1. The covering 13 may be formed of, for example, transparent plastic. A desired pattern, design, or letters can be printed on the covering 13, except that no printing must be made on a portion 13*a* corresponding to the opening a of the case body 1 because the corresponding portion 13*a* should not block the view of the inside of the case through the opening a.

In use, it is first necessary to supply cigarettes into the case. Thus, it is first necessary to remove the side wall member 9 from the case body 1. Then, cigarettes are supplied from the open side 4 into the case body 1. Then, the open side 4 is again closed with the side wall member 9. Since, as described above, each spring 10 presses the cigarettes of one row against the slider 5, the leftmost cigarette (in FIG. 2) of each row rides on the bottom portion 5*d* of the slider 5.

Then, as shown in FIGS. 2 and 3, the user applies the thumb of his hand holding the case to the handle 8, and raises the handle 8. Thus, the slider 5 moves upwardly with its bottom portion 5*d* supporting the two leftmost cigarettes A. When the upper member 5*a* of the upright portion entirely comes from the opening 3, the upper member 5*a* (and the lid portion 5*c* formed integrally therewith) is turned outwardly by the action of the coil spring 7 (FIGS. 2 and 3) because the upper member 5*a* no longer is in contact with the side 1*a* of the case body 1. The tops of the leftmost cigarettes are thus exposed from the case body 1 and, hence, the user can take out one of the cigarettes from the case. After taking out one cigarette, the user lowers the handle 8 to return the slider 5 into the case body 1. Thus, the upper member 5*a* of the upright portion returns again to the vertical position in the case body 1 and at the same time the lid portion 5*c* closes the opening 3 again. When the slider 5 has returned to the initial position in the case body 1, the next cigarette of the row having lost one cigarette rides on the bottom portion 5*d* of the slider 5 by the action of the coil spring 10.

If desired, the springs 10 for pressing the cigarettes may be omitted. If they are omitted, the extreme cigarettes in the case can be moved on the bottom portion 5*d* of the slider 5 by inclining the case as shown in FIG. 3.

Also, if desired, the slider 5 may be formed of elastic material as one body, and an angular portion (5*a*, 5*c*) may be curved outwardly. Such a slider will act in the same manner as the illustrated slider 5.

What is claimed is:

1. A container for holding and dispensing cigarettes comprising in combination (A) a case body (1) which comprises (a) a rectangular top wall (1*b*) and a spaced apart rectangular bottom wall of corresponding size and shape, (b) two spaced apart side walls connecting said top wall (1*b*) and said bottom wall along the longer of said dimensions of said rectangular top wall (1*b*) and the corresponding rectangular bottom wall, (c) a fixed end wall (1*a*) connecting said top wall (1*b*) and said bottom wall along the shorter dimension of said rectangular top wall (1*b*) and the corresponding rectangular bottom wall, (d) a removable end wall (9) extending between said top wall (1*b*) and said bottom wall along the shorter dimension of said rectangular top wall (1*b*) and the corresponding rectangular bottom wall, (e) an opening (3) in said top wall (1*b*) adjacent the juncture with said fixed end wall (1*a*) that is large enough for the removal for one or two cigarettes, (f) a vertical slit (2) in said fixed end wall (1*a*), and (B) a slider (5) mounted for vertical sliding movement along the interior side of said fixed end wall (1*a*) in a path which is closely parallel to said fixed end wall (1*a*) and perpendicular to said top wall (1*b*), said slider (5) including (a) an upper portion (5*a*) and a lower portion (5*b*) that are hingedly connected together so that the upper portion (5*a*) can pivot outwardly after it passes through said opening (3), (b) a lid portion (5*c*) on said upper portion (5*a*) which covers said opening (3) when the slider (5) is in its lowermost position, and which does not cover said opening (3) when the slider (5) is in its uppermost position, (c) a bottom support (5*d*) on said lower portion (5*b*) which is parallel to said bottom wall, which projects toward said removable end wall (9) and which is of sufficient size to support one or two cigarettes thereon, and (d) a control member (5*e*) (8) on said slider (5) which extends outwardly through the vertical slit (2) in said fixed end wall (1*a*) that permits said slider (5) to be manually moved up and down along a controlled vertical path within said case body (1).

2. A cigarette container according to claim 1 wherein said upper portion (5*a*) and lower portion (5*b*) are connected by a pin (6) so that the upper portion (5*a*) can be pivoted relative to the lower portion (5*b*) and a coil spring (7) is provided on the pin (6) to bias the upper portion (5*a*) outwardly.

3. A cigarette container according to claim 1 further including means (10) connected to the inner surface of the removable end wall (9) for pressing the cigarettes in the container against the fixed end wall (1*a*).

* * * * *